United States Patent [19]

Perriniaux

[11] 4,030,115

[45] June 14, 1977

[54] VERTICAL TANK FOR DEVELOPING PHOTOGRAPHIC MATERIAL

[75] Inventor: Claude M. Perriniaux, Auxerre, France

[73] Assignee: Anvar Agence Nationale de Valorisation de la Recherche, Neuilly sur Seine, France

[22] Filed: Nov. 12, 1975

[21] Appl. No.: 631,398

[30] Foreign Application Priority Data

Nov. 20, 1974 France ..... 74.38189

[52] U.S. Cl. ..... 354/299; 354/307; 354/316; 354/323; 354/331

[51] Int. Cl.[2] ..... G03D 13/00

[58] Field of Search ..... 354/297, 299, 307, 310, 354/311, 312, 313, 316, 323, 324, 329, 331, 337, 338, 336

[56] References Cited

UNITED STATES PATENTS

| | | | |
|---|---|---|---|
| 2,212,357 | 8/1940 | Vanderwalker | 354/311 |
| 2,359,611 | 10/1944 | Bolsey | 354/338 X |
| 2,530,734 | 11/1950 | Salzman | 354/329 X |
| 2,804,003 | 8/1957 | Hoffman | 354/329 |
| 2,957,401 | 10/1960 | Hutton | 354/299 |
| 3,587,429 | 6/1971 | Morse | 354/336 X |
| 3,688,678 | 9/1972 | Dalen | 354/329 |

FOREIGN PATENTS OR APPLICATIONS

| | | | |
|---|---|---|---|
| 1,071,796 | 9/1954 | France | 354/331 |
| 579,445 | 6/1933 | Germany | 354/307 |

*Primary Examiner*—Fred L. Braun

[57] ABSTRACT

A development tank for the daylight development of photographic material comprises inner and outer vessels, axially reciprocal in relation to one another, and defining between them an annular space in which the material to be treated is placed in the absence of light, this space then being closed light-tight by a lid. The inner vessel provides a water bath by which the treatment solution is heated and maintained at the desired temperature. The treatment solution is introduced into a closable conduit and is delivered to the annular space and discharged therefrom by the axial movement of the vessels relative to one another.

11 Claims, 3 Drawing Figures

VERTICAL TANK FOR DEVELOPING PHOTOGRAPHIC MATERIAL

FIELD OF THE INVENTION

This invention relates to a vertical tank intended for the "daylight" development of photographic sheet material in accordance with the "non-re-usable bath" method.

DESCRIPTION OF THE PRIOR ART

The "daylight" developing process, which is applicable in an especially advantageous manner to colour photography, comprises disposing the sheets to be treated, in the absence of light, in a casing or tank which can be sealed to light and which generally has at least one orifice for the introduction or discharge of the treatment materials. After the casing has been closed, the said sheets can no longer be subjected to the action of light, and the operator can then carry out the various phases of treatment in daylight without risk of the sheets being affected by the light.

The "non-re-usable bath" technique consists in using small quantities of treatment materials which are not re-used.

In the majority of cases, during the various treatments, the materials introduced into the tank must be kept at a constant temperature and must be agitated in order to render uniform the chemical reactions which occur on the sheets.

SUMMARY OF THE INVENTION

An object of the present invention is to provide a tank for daylight developing according to the technique of the non-re-usable bath, which reduces the quantity of products utilised for each treatment; facilitates the maintenance of the treatment materials at a desired temperature and permits of their agitation; and finally is sufficiently simple and low in cost to permit its utilisation by amateurs as well as by professionals.

From one aspect, the invention provides a vertical tank for the "daylight" development of sheet photographic materials by the "non-re-usable bath" technique comprising an outer tubular vessel open at its top, an inner tubular vessel slidable axially relatively to the said outer vessel and defining therewith an annular chamber for the reception of the materials to be treated and a lower chamber between the bottoms of the two vessels, to receive the treatment solutions; at least one closable conduit for the introduction of the treatment solutions into the said lower chamber, means for effecting the discharge of said solutions from the said lower chamber, and a lid providing a light-tight closure of at least the volume included between the two vessels, and permitting relative axial sliding of the vessels.

In a preferred form, a vertical tank comprises a first tubular vessel, preferably cylindrical, open at its upper end and comprising in its lower part an inwardly projecting shoulder followed by a part, for example a conical part, narrowing to a bottom provided with at least one closable discharge orifice. A second tubular vessel, for example cylindrical, of diameter slightly less than that of the first vessel, is open at its upper end and comprises in its lower part a portion, for example a conical portion narrowing to a bottom equipped with at least one closable orifice. From the orifice there extends a conduit, for the introduction of the treatment solutions, which rises inside, and exceeds the height of this second vessel. The two vessels are fitted one into the other so as to form an annular lateral chamber in which the sheets to be treated are disposed, with their edges resting on the said shoulder. The said annular chamber communicates at its lower end with a chamber formed in the space between the two bottoms. The tank also comprises at least one lid permitting of light-tightly closing the assembly of the two vessels, this lid being pierced by the said conduit and permitting a displacement of one of the vessels in relation to the other.

It is thus possible to fill the annular chamber with treatment solution through the intermediary of the said conduit and then to discharge it through the said discharge orifices. The maintenance of a constant temperature of the treatment solutions can easily be obtained initially, before their use, and during treatment by a water bath, formed by filling the said second vessel with water which is subsequently maintained at the desired temperature, for example by means of a heater and a thermostat.

Agitation during treatment can finally be obtained by sliding one of the vessels in relation to the other.

DESCRIPTION OF THE DRAWINGS

Some preferred forms of the invention will now be described by way of example with reference to the accompanying drawings in which:

As shown in FIGS. 1 and 2, the amateur developing tank 1 comprises an outer vessel 2 having a cylindrical part with an inwardly projecting circular shoulder 3 at its lower end. This shoulder 3 is prolonged by a conical part 4 terminating at a bottom 5. This bottom 5 is provided with discharge orifices 6 and with a tubular sleeve 7 open to the exterior at its lower end and closed at its upper end. The sleeve 7 is coaxial with the vessel 2.

Figure 1:
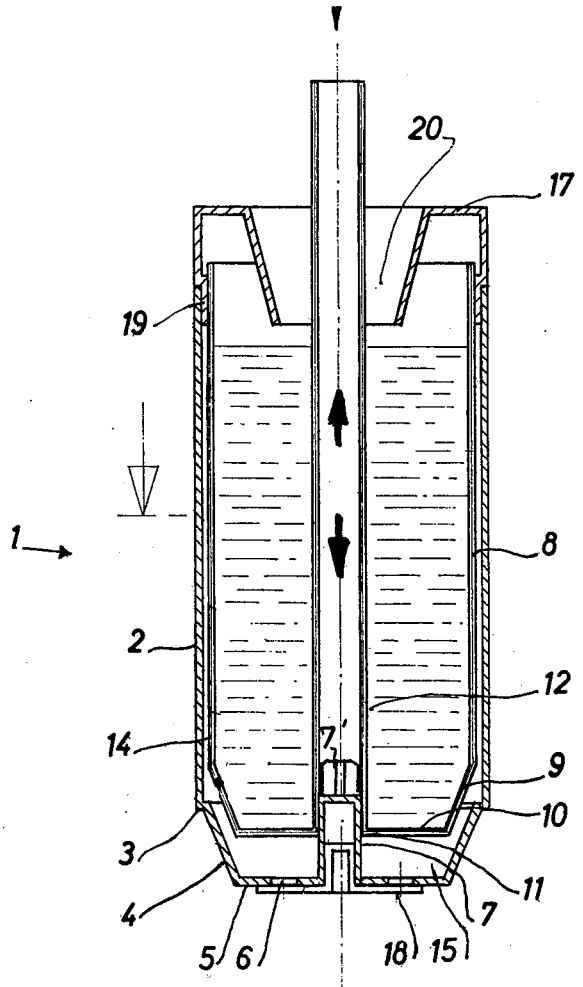
FIG. 1 is a cross-section of a developing tank especially designed for use by amateurs.

Inside the vessel 2 there is coaxially disposed a second vessel 8 having a cylindrical part of slightly smaller diameter than the vessel 2. This vessel 8 comprises at its lower end a conical part 9 terminating in a flat bottom 10 having a central aperture 11 from which extends a tube 12 coaxial with the vessel 8 and extending within the latter.

This tube 12 is of length greater than the height of the two vessels 2 and 8, and issues from these to the exterior. The diameter of the tube 12 is such that when the two vessels 2, 8 are disposed one within the other, the tubular sleeve 7 is introduced into the tube 12 and closes it in sealed manner, while permitting reciprocal axial sliding.

In this connection, it will be noted that the tubular sleeve 7 can include means in its upper part permitting axial guidance of the inner tank 8, when the latter is raised to permit passage of the treatment solution contained in the tube 12. These guide means can consist for example of a vertical cruciform piece 7′ disposed on the upper surface of the tubular sleeve 7, the width of its arms being substantially equal to the internal radius of the tube 12.

The two vessels thus fitted into one another define an annular chamber 14 of small width communicating with a substantially frustoconical chamber 15 defining the two bottoms 5 and 10. This annular chamber 14 is intended to receive the sheets to be developed which are retained by their lower edges abutting on the shoulder 3.

Figure 2:
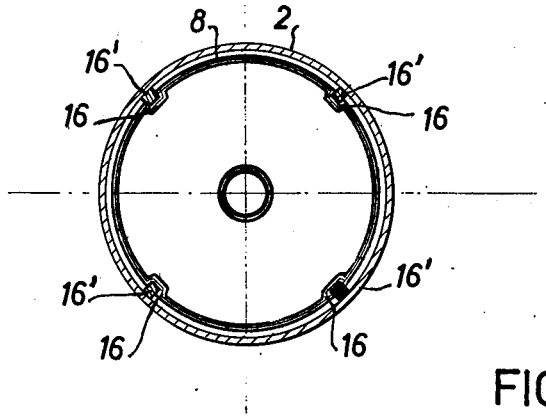
FIG. 2 is a transverse section of the form shown in FIG. 1.

In order to guide the sheets in the annular chamber, the cylindrical vessel 8 can have, as shown in FIG. 2, four vertical grooves 16 in which there are disposed tongues 16' on the internal surface of the outer vessel 2.

The two tanks 2 and 8 are closed in light-tight manner by a single lid 17 from which the tube 12 issues. The lid 17 comprises a skirt 19 which engages in the interval of the two tanks 2 and 8 and a central aperture 20 through which the tube 12 passes and which permits filling of the tank 8 for example by a water bath.

The discharge orifices 6 of the tank 2 can be closed by a valve 18 which engages in the tubular sleeve 7.

The assembly of the tank 1, prior to the development operations, can be carried out as follows:

Firstly the two vessels 2 and 8 are fitted one into the other until the tubular sleeve 7 fits into the tube 12.

The valve 18 is introduced into the tubular sleeve 7 so as to effect closure of the discharge orifices 6.

After the tongues 16' have been slipped into the grooves 16 of the tank 8, it is then possible, in the absence of light, to introduce the sheets to be treated into the annular chamber 14 until they abut on the shoulder 3, the sensitive face (emulsion) of these sheets being turned towards the interior of the tank 1.

Then the lid 17 is fitted on to the vessels 2 and 8 so as to render the annular chamber 14 light-tight. Once the lid 17 is in place the two vessels 2 and 8 are perfectly centred, on the one hand at the bottom by engagement of the tubular sleeve 7 in the tube 12 and on the other at the top by engagement of the skirt 19 of the lid between the two vessels 2 and 8.

As from the moment when the lid 17 is suitably engaged on the vessels 2 and 8, all treatment can be carried out in daylight.

For this purpose, firstly the interior of the tank 8 is filled with water brought to the temperature at which the treatment must be effected. The temperature is of course dependant on the materials to be treated.

Then the quantity of solution necessary for the treatment is disposed in the tube 12 of the inner vessel 8 and one then waits until the solution reaches the water bath temperature.

To facilitate heat exchange, the vessel 8 and the tube 12 can be made of thermally conductive material, for example of an alloy commonly called Alpax coated with a layer of polytetrafluoroethylene (Teflon).

When the solution reaches the desired temperature, the inner vessel 8 is raised by means of the tube 12 which protrudes from the lid 17, until the vessel 8 comes to abut against the lid 17.

In this position, the sleeve 7 is disengaged from the tube 12, which however is still guided at its lower end by the cruciform piece 7', and the treatment solution in the tube 12 is discharged towards the bottom 5 of the vessel 2 into the chamber 15. At this moment, the treatment solution is not in contact with the sheets to be treated. This particular feature is very important to ensure uniformity of the chemical reactions which must take place during one and the same period of time over the whole area of the sheet. If at this stage, the treatment solution were to reach part of the sheets to be treated, the duration of treatment would be greater in these parts than in the remainder of the sheets. In consequence, in the case of colour photography, the uniformity of the colours would not be respected.

The introduction of the solution into the annular chamber 14 is effected by fully engaging the vessel 8 in the vessel 2 so that their respective bottoms 5 and 10 are brought into contact with one another.

During this operation the current of liquid, guided between the two conical surfaces 4 and 9, presses the sheets to be treated flat against the inner wall of the vessel 2. This feature, essentially due to the form of the vessels 2 and 8, prevents the sensitive faces of the sheets from adhering to the external surface of the vessel 8. It is thus not necessary to provide longitudinal channels on the external face of the tank 8. However, such channels may be provided by way of improvement.

At the end of the treatment, it is sufficient to disengage the valve 18 from the discharge orifices 6, for example by raising the vessel 2 if the valve 18 serves also as a support for the vessel 2. The solution can then be discharged by gravity.

For each subsequent treatment, the operations as described above are repeated.

The means for emptying the tank could be quite different; for example the valve 18 could be provided with a series of holes distributed in a manner similar to the discharge orifices 6, so that the discharge of the solution can be effected by bringing the said orifices into coincidence with the said holes by rotating the vessel 2 in relation to the valve 18. To facilitate the operation, the rotation of the vessel 2 can be limited for example by abutments which come into action at the precise moment when there is coincidence between the said orifices and the said holes.

It will be noted that during these treatments, agitation of the solutions can be effected by imparting a slight axial reciprocating movement to the tube 12. Moreover to keep the water bath at a constant temperature, it is possible to introduce a thermostatically controlled heater through the orifice 20 of the lid.

Figure 3:
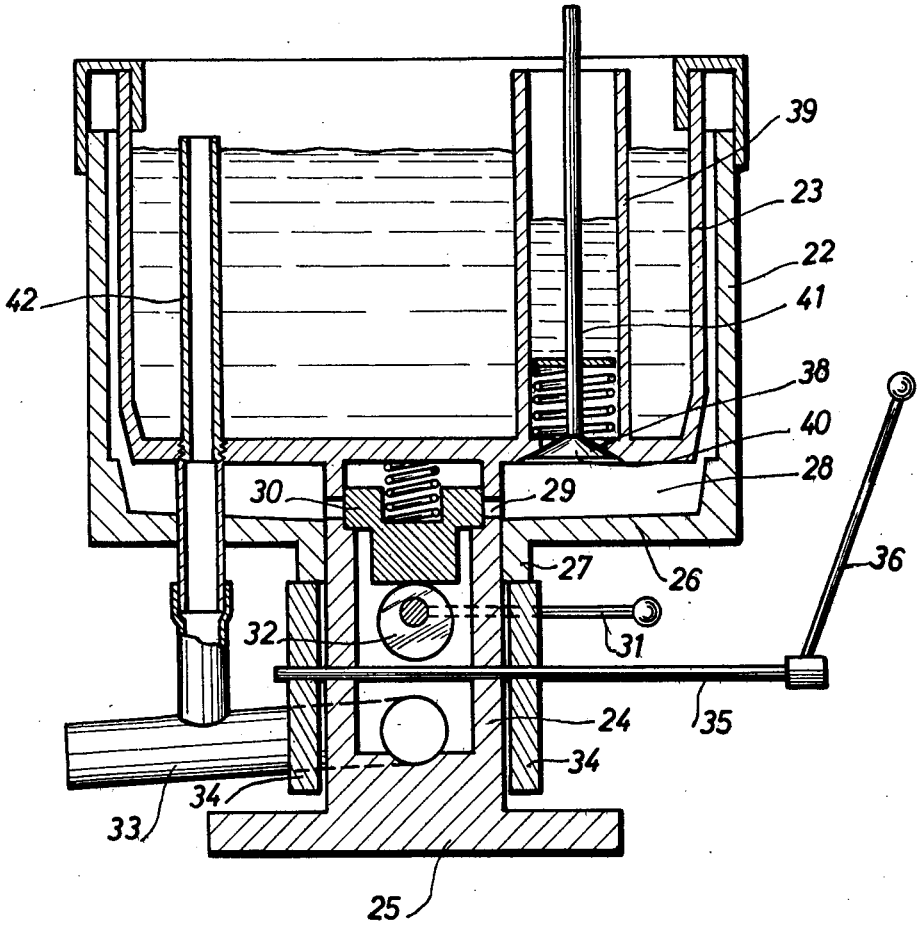
FIG. 3 is an axial section of a more complex tank intended for use by professionals.

As shown in FIG. 3, the development tank for professional use essentially comprises two coaxial vessels 22, 23 fitted one into the other and shaped as described with reference to FIGS. 1 and 2.

The inner vessel 23 is fixedly mounted on a tubular foot 24 carried by a base 25. The outer vessel 22 is axially movable and comprises a bottom 26 having a central opening providing a bearing 27 in which the foot 24 fits. The bearing 27 is arranged to permit its sliding along the foot 24, while preserving the seal of the tank 22.

The tubular foot 24 includes at the level of the chamber 28 defined by the bottoms of the vessels 22, 23 discharge orifices 29 open towards the interior of the foot 24 and closable by means of a valve 30 which is operable by a lever 31 fast with a cam 32. The bottom of the foot 24 communicates with a discharge conduit 33 intended to receive the treatment solutions after use.

The displacement of the vessel 22 is controlled by two cams 34 which act upon the bearing 27 and of which the spindle 35, secured to a control lever 36, is carried transversely by the foot 24. This shaft 35 could be operated by a conventional motor-reduction gearing assembly rotating for example at about 8 to 10 rpm.

In the bottom of the vessel 23, is a series of apertures 38 distributed eccentrically or in a ring about the axis of the vessel 23. From each of these apertures 38 a tube 39 extends parallel to the axis of the tank 23, extending inside the latter over the whole of its height.

The apertures 38 are each closable by a valve 40 controllable by a rod 41 coaxial with the tube 39 and protruding from the upper end of the latter.

These tubes 39, at least five in number, are intended for keeping the treatment solutions waiting at the desired temperature.

The vessel 23 can also include an overflow conduit 42 connected to the discharge conduit 33, this conduit 42 being screwed on to the bottom of the vessel 23 so that when it is unscrewed the water bath contained in the said vessel 23 can be discharged.

To facilitate the removal of the treated sheets, the cylindrical part of the vessel 22 is dismantleable from its bottom, so that this recovery can be effected by removing the said cylindrical part.

The principle of operation of this tank in analogous to that previouly described with reference to FIGS. 1 and 2, and will not be described again. It should however be noted that this type of tank lends itself to complete automation, it being possible for the various valves 30, 40 to be controlled by a programme system. The heating of the water bath can be effected either by a thermostatic block or with a resistor.

It will be noted that, in contrast with the previously described tanks, the inner vessel could have a shoulder at its lower end and the outer vessel could have a widened portion at this level, so that the sheets to be treated, disposed in the annular chamber with their sensitive faces oriented outwards, can rest on the said shoulder. In this case, the current of liquid caused by bringing together the bottoms of the two vessels presses the sheets flat against the outer wall of the inner vessel and thus prevents the sensitive faces of the sheets from adhering to the inner wall of the outer vessel.

I claim:

1. A vertical tank for the daylight development of sheet-type photographic materials comprising:
   a. an outer tubular vessel having a closed bottom and open at its top;
   b. an inner tubular vessel having a closed bottom, a space being formed between said vessels;
   c. an annular chamber defined between said inner and outer vessels and adapted to receive the sheets to be treated;
   d. a lower chamber defined between the closed bottoms of said inner and outer vessels and communicating with said annular chamber;
   e. at least one closable conduit communicating with said lower chamber for the introduction of treatment solution into said lower chamber;
   f. means for effecting the discharge of said solution from said lower chamber;
   g. a lid for forming at least a light-tight recess defined by the space included between the two vessels and said lid; and
   h. sliding means for axial motion of one of said vessels with respect to the other of said vessels for forcing the treatment solution introduced into said lower chamber into said annular chamber for development of the sheet-type photographic materials.

2. A tank as claimed in claim 1, wherein said lid comprises a skirt extending into the space between the two vessels to close the annular chamber in light-tight manner.

3. A tank as claimed in claim 1, having an overflow conduit in said inner vessel, said conduit being removable to discharge liquid from said vessel.

4. A tank as claimed in claim 1, comprising a plurality of conduits, arranged eccentrically around the axis of said inner vessel and each extending from an aperture in the bottom of the inner vessel parallel to the axis thereof, each of said apertures being closable by a valve controlled by a rod coaxial with one of the eccentric conduits, respectively, and protruding from the upper end thereof.

5. A tank as claimed in claim 1, comprising a tubular foot on which said inner vessel is fixedly mounted, said outer vessel being axially movable, a bearing on the bottom of said outer vessel slidably engaged with said foot, and maintaining the seal of said outer vessel, said foot including discharge orifices open to the interior of said foot, a valve controlling said discharge orifices and a discharge conduit communicating with the interior of the foot below said valve.

6. A vertical tank for the daylight development of sheet photographic materials by the non-re-usable bath technique comprising:
   a. a first cylindrical vessel open at its top and having at its bottom an inwardly projecting shoulder and a lower portion narrowing to a bottom having at least one closable discharge orifice;
   b. a second vessel open at its top disposed within said first cylindrical vessel;
   c. said second vessel comprising a cylindrical part of diameter slightly smaller than that of the first vessel, a lower portion narrowing to a bottom having at least one closable orifice;
   d. a tubular conduit for the introduction of treatment solution extending from said closable orifice through said cylindrical part of said inner vessel;
   e. said first and second vessels defining between them an annular chamber wherein sheets of photographic material may be disposed with their lower edges resting on said shoulder and a lower chamber to receive treatment solution from said conduit and in communication with said annular chamber;
   f. a lid closing the top of said annular chamber in light-tight manner; and
   g. means for sliding said two vessels relatively to one another whereby solution in said conduit is passed into said lower chamber and thence to the annular chamber.

7. A tank as claimed in claim 6, wherein said second vessel is adapted to be filled with a liquid at a desired temperature, the liquid being maintained at said temperature by a thermostatically controlled heater.

8. A tank as claimed in claim 6, wherein complementary vertical grooves and tongues on confronting surfaces of said two vessels are provided to guide the vessels in relative axial movement.

9. A tank as claimed in claim 6, having a co-axial tubular sleeve in the bottom of said first vessel, said sleeve being open to the exterior and closed at its top end, said sleeve engaging in the tubular conduit of said second vessel to close said tubular conduit, said sleeve being axially slidable relative to said conduit.

10. A tank as claimed in claim 9, having a valve engaged in said sleeve and operable to close discharge orifices in the bottom of said first vessel.

11. A vertical tank for the daylight development of sheet photographic materials by the non-re-usable bath technique comprising:

a. a first cylindrical vessel open at its top and having a lower portion narrowing to a bottom having at least one closable discharge orifice;

b. a second vessel open at the top disposed within said first cylindrical vessel;

c. said second vessel comprising a cylindrical part of diameter slightly smaller than that of the first vessel, an outwardly projecting shoulder at the bottom of said cylindrical part and a lower portion narrowing to a bottom having at least one closable orifice;

d. a conduit for the introduction of treatment solution extending from said closable orifice through said cylindrical part of said inner vessel;

e. said first and second vessels defining between them an annular chamber wherein sheet of photographic material may be disposed with their lower edges resting on said shoulder and a lower chamber to receive treatment solution from said conduit and in communication with said annular chamber;

f. a lid closing the top of said annular chamber in light-tight manner; and g. means for sliding said two vessels relatively to one another whereby solution in said conduit is passed into said lower chamber and thence to the annular chamber.

* * * * *